US005205706A

United States Patent [19]

Belcher

[11] Patent Number: 5,205,706

[45] Date of Patent: Apr. 27, 1993

[54] AXIAL FLOW TURBINE ASSEMBLY AND A MULTI-STAGE SEAL

[75] Inventor: Bryan L. Belcher, Leamington Spa, England

[73] Assignee: Rolls-Royce plc, London, England

[21] Appl. No.: 831,060

[22] Filed: Feb. 4, 1992

[30] Foreign Application Priority Data

Mar. 2, 1991 [GB] United Kingdom ..... 9104457

[51] Int. Cl.[5] ..... F01D 3/00; F01D 3/02

[52] U.S. Cl. ..... 415/105; 415/106; 415/115; 415/174.4; 415/174.5; 415/170.1

[58] Field of Search ..... 415/104, 105, 106, 107, 415/115, 116, 170.1, 173.1, 173.4, 173.5, 173.7, 174.4, 174.5

[56] References Cited

U.S. PATENT DOCUMENTS

| | | | |
|---|---|---|---|
| 2,530,477 | 11/1950 | Ostmar | 415/104 |
| 3,746,462 | 7/1973 | Fukuda . | |
| 4,662,821 | 5/1987 | Kervistin et al. | 415/116 |

FOREIGN PATENT DOCUMENTS

| | | | |
|---|---|---|---|
| 0015487 | of 1913 | United Kingdom | 415/104 |
| 385592 | 3/1931 | United Kingdom . | |
| 895467 | 5/1962 | United Kingdom . | |
| 1193800 | 6/1970 | United Kingdom . | |
| 1194663 | 6/1970 | United Kingdom | 415/415 |
| 1441855 | 7/1976 | United Kingdom . | |
| 2021207 | 8/1979 | United Kingdom . | |
| 2111598 | 6/1983 | United Kingdom . | |
| 2119027 | 9/1983 | United Kingdom . | |

*Primary Examiner*—Edward K. Look
*Assistant Examiner*—Christopher Verdier
*Attorney, Agent, or Firm*—Cushman, Darby & Cushman

[57] ABSTRACT

A labyrinth seal positioned between a turbine rotor and inner platforms of vanes of a turbine assembly controls the leakage flow of fluid from a chamber to the flowpath through the turbine assembly. The labyrinth seal is divided into two parts by a second chamber positioned between two adjacent fins of the labyrinth seal. The chamber is located at a predetermined position in the seal such that a predetermined pressure, sufficient to supply fluid to cool a stage of turbine rotor blades in the turbine assembly, is selected. The second chamber is interconnected to the turbine blades by passages, and a chamber. The pressure of fluid in the second chamber is less than that which would normally exist in the second chamber, because fluid is being supplied from the second chamber to the second stage of turbine rotor blades. The flow of fluid from the second chamber, through the second part of the labyrinth seal, to the flowpath through the turbine is therefore reduced.

18 Claims, 2 Drawing Sheets

AXIAL FLOW TURBINE ASSEMBLY AND A MULTI-STAGE SEAL

BACKGROUND OF THE INVENTION

1. Field of the Invention

The invention relates to turbine assemblies, and is particularly concerned with controlling the flow of fluid through a multi-stage seal from a chamber defined between a turbine rotor and a stator inner casing to a flowpath through the turbine.

2. Description of the Related Art

A known turbine assembly comprises a turbine rotor and a stator. The turbine rotor comprises a plurality of stages of radially outwardly extending fluid cooled hollow turbine rotor blades. The stator comprises an outer casing which defines at least a portion of the radially outer extremity of a flowpath through the turbine. The outer casing encloses the turbine rotor and turbine rotor blades, and the outer casing comprises a plurality of stages of radially inwardly extending turbine stator vanes. The stator also includes an inner casing which defines at least a portion of the radially inner extremity of the flowpath through the turbine. A chamber is defined between the downstream end of the turbine rotor and the inner casing. Pressurised fluid is supplied to the chamber to apply an axial thrust on the turbine rotor to balance the resultant load on the turbine rotor. A multi-stage seal is provided between the turbine rotor and the inner casing to control the flow of fluid from the chamber into the flow path through the turbine.

SUMMARY OF THE INVENTION

The present invention seeks to provide a turbine assembly in which the flow of fluid through the multi-stage seal between the turbine rotor and the inner casing is reduced.

Accordingly the present invention provides an axial flow turbine assembly comprising means defining an annular turbine flowpath, a turbine rotor comprising at least one stage of radially outwardly extending turbine rotor blades in said flowpath, a stator having an outer casing defining at least a portion of the radially outer extremity of said flowpath, the outer casing including at least one stage of radially inwardly extending turbine stator vanes in said flowpath, the turbine stator vanes having inner platform means defining at least a portion of the radially inner extremity of said flowpath, a chamber being defined between the turbine rotor and the inner platform means, means being arranged to supply fluid at a predetermined pressure to the chamber, a multi-stage seal being arranged between the turbine rotor and the inner platform means to control the flow of fluid from the chamber into said flowpath, means to bleed fluid from a predetermined position in the multi-stage seal to cool at least one component of the turbine assembly.

Preferably the at least one component is a stage of fluid cooled hollow turbine blades.

Preferably the turbine rotor comprises a plurality of stages of turbine rotor blades and the outer casing comprises a plurality of stages of turbine stator vanes.

Preferably the seal is a labyrinth seal, the labyrinth seal comprises a plurality of axially spaced fins, the fins extending radially inwardly from the inner platform means or extending radially outwardly from the turbine rotor.

Preferably the predetermined position is between two axially adjacent fins.

Preferably a second chamber is formed between the axially adjacent fins.

Preferably the multi-stage seal is a ten stage seal. The predetermined position may be between the seventh and eighth fins in an axially downstream direction. The predetermined position may be between the eighth and ninth fins in an axially downstream direction.

Preferably the turbine assembly is a low pressure turbine. The turbine rotor may comprise three stages of turbine rotor blades and the outer casing comprises three stages of turbine stator vanes. The fluid bled from the multi-stage seal may be supplied to the second stage of turbine rotor blades.

Preferably the turbine rotor comprises at least one passage to interconnect the second chamber and the stage of turbine blades supplied with fluid.

Preferably the outer diameter of the turbine rotor and the inner diameter of the inner platform means in the region upstream of the predetermined position, with respect to the direction of the leakage flow of fluid through the multi-stage seal, are greater than the outer diameter of the turbine rotor and the inner diameter of the inner platform means in the region downstream of the predetermined position.

Preferably the means to supply pressurising fluid to the chamber is a compressor. The turbine assembly and the compressor may be portions of a gas turbine engine.

Preferably the turbine rotor has at least one restricted passage to interconnect the first chamber and the second chamber.

The present invention also provides a multi-stage seal positioned between relatively rotating members to control the flow of fluid between the members, comprising means to bleed fluid at a predetermined pressure from a predetermined position in the multi-stage seal to reduce the leakage flow of fluid through the multi-stage seal.

Preferably the multi-stage seal is a labyrinth seal, the labyrinth seal comprises a plurality of spaced fins, the fins extending from one of the relatively rotating members towards the other of the relatively rotating members.

BRIEF DESCRIPTION OF THE DRAWINGS

The present invention will be more fully described by way of example with reference to the accompanying drawings, in which.

DESCRIPTION OF THE PREFERRED EMBODIMENT

Figure 1:
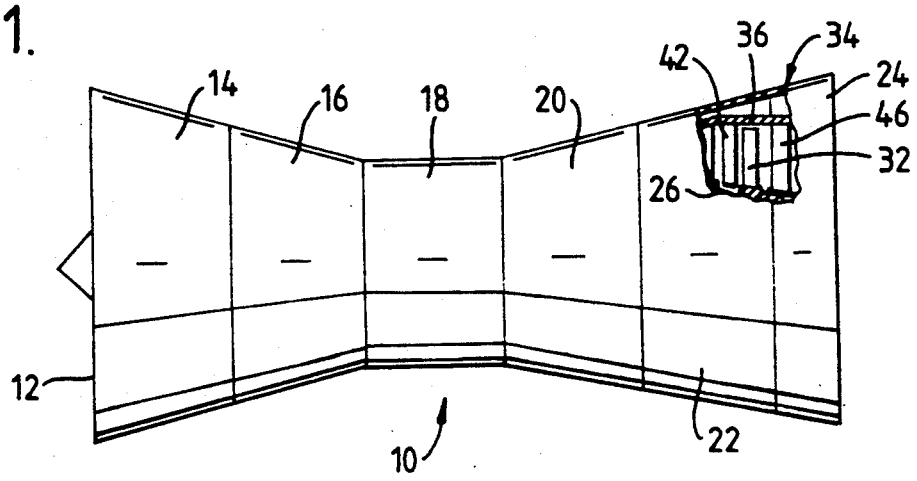
FIG. 1 is a partially cut away view of a gas turbine engine showing a turbine assembly according to the present invention.

A gas turbine engine 10, shown in FIG. 1, comprises in axial flow series an inlet 12, a low pressure compressor 14, a high pressure compressor 16, a combustor 18, a high pressure turbine 20, a low pressure turbine 22 and an exhaust 24. The high pressure turbine 20 is drivingly connected to the high pressure compressor 16 via a first shaft, not shown, and the low pressure turbine 22 is drivingly connected to the low pressure compressor 14 via a second shaft, not shown. The gas turbine engine operates quite conventionally, in that air is taken into the gas turbine engine 10 through the inlet 12 and is compressed firstly by the low pressure compressor 14 and secondly by the high pressure compressor 16. Fuel is injected into the combustor 18 and is ignited and burnt in compressed air, supplied from the high pressure compressor 16, to produce hot gases. The hot gases expand through, and drive, the high pressure turbine 20 and the low pressure turbine 22 before passing through the exhaust 24 to atmosphere. The high pressure turbine 20 and low pressure turbine 24 are arranged to drive the high pressure compressor 14 and low pressure compressor 16 respectively.

Figure 2:
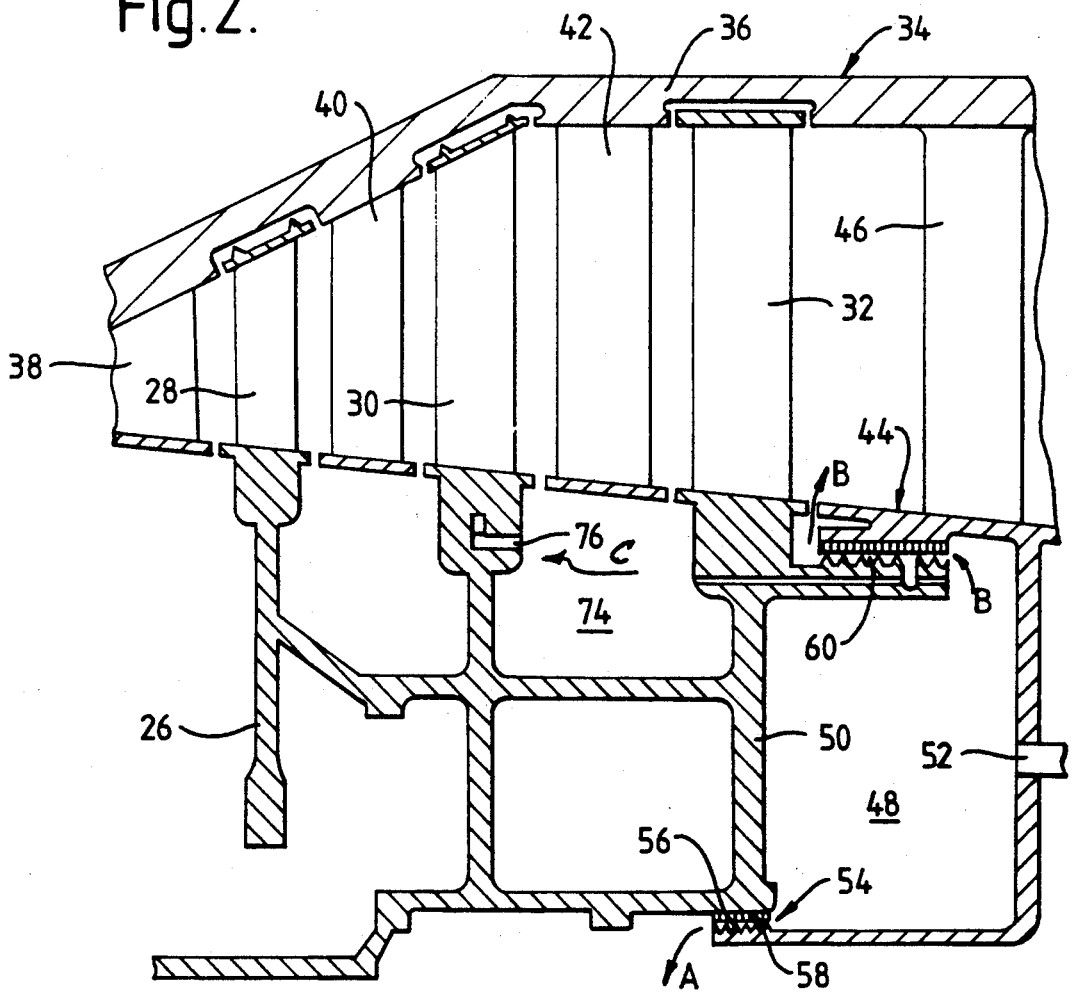
FIG. 2 is an enlarged longitudinal cross-sectional view through the turbine assembly shown in FIG. 1.

The low pressure turbine 22 is shown more clearly in FIG. 2 and comprises a turbine rotor 26 and a turbine stator 34. The turbine rotor 26 comprises three axially spaced stages of hollow fluid cooled turbine rotor blades 28,30 and 32. The turbine rotor blades 28,30 and 32 extend radially outwardly from the turbine rotor 26. The turbine stator 34 comprises an outer casing 36 which encloses the turbine rotor 26 and turbine rotor blades 28,30 and 32. The turbine stator comprises three axially spaced stages of hollow fluid cooled turbine stator vanes 38,40 and 42. The turbine stator vanes 38,40 and 42 extend radially inwardly from the outer casing 36. The turbine stator 34 also comprises an inner casing 44, which is secured to the outer casing 36 by a plurality of circumferentially arranged, radially extending, struts 46. The inner casing 44 includes the inner platforms of the stator vanes, or struts 46. The stator vanes 46 are positioned downstream of the last stage of turbine rotor blades 32.

The outer casing 36 partially defines the radially outer extremity of the gas flowpath through the low pressure turbine 22. The shrouds on the tips of the turbine rotor blades 28,30 and 32 define the remainder of the radially outer extremity of the gas flowpath through the low pressure turbine 22.

The inner platforms, of the stator vanes 46, of the inner casing 44 partially defines the radially inner extremity of the gas flow path through the low pressure turbine 22. The inner platforms on the radially inner ends of the turbine stator vanes 38,40 and 42 and the platforms on the turbine rotor blades 28,30 and 32 define the remainder of the radially inner extremity of the gas flowpath through the low pressure turbine 22.

A chamber 48 is defined between the downstream surface 50 of the turbine rotor 26 and the inner casing 44. The chamber 48 is supplied with fluid, air, from the compressor 14 or 16 through a pipe 52. The fluid is preferably bled from a position in the compressor 14 or 16 downstream of the upstream end of the compressor 16. The fluid is supplied to the chamber 48 to provide a thrust load, acting in an axially upstream direction, on the downstream surface 50 of the turbine rotor 26 to oppose the loads acting on the turbine rotor 26.

A first seal assembly 54, is provided between the radially inner region of the turbine rotor 26 and the inner casing 44, to control a leakage flow A of fluid from the chamber 48. The first seal assembly 54 is a labyrinth type seal which comprises a plurality of axially spaced, radially outwardly extending, fins 56 on the inner casing 44 and a honeycomb structure 58 on the turbine rotor 26.

Figure 3:
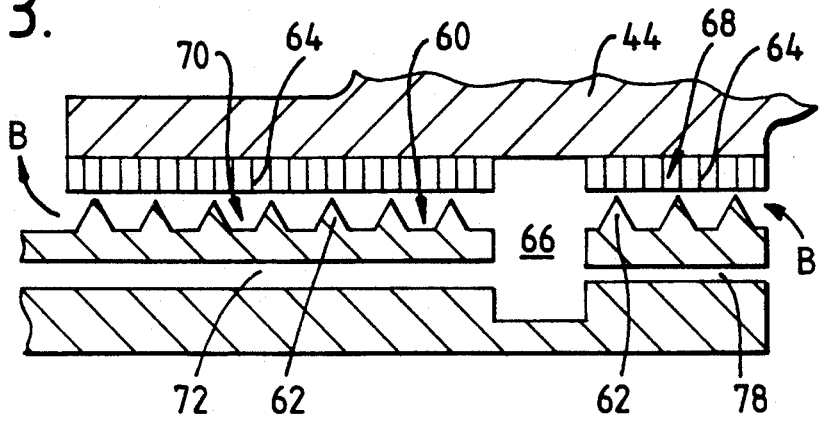
FIG. 3 is a further enlarged cross-sectional view through a multi-stage seal shown in FIG. 2.

A second seal assembly 60, is provided between the radially outer region of the turbine rotor 26 and the inner platforms, of the stator vanes 46, of the casing 44, to control a leakage flow B of fluid from the chamber 48 into the flowpath through the low pressure turbine 22. The second seal assembly 60, shown more clearly in FIG. 3, is a labyrinth type seal which comprises a plurality of axially spaced, radially outwardly extending, fins 62 on the turbine rotor 26 and a honeycomb structure 64 on the inner platforms, of the stator vanes 46, of the inner casing 44. The labyrinth seal assembly 60 is a multi-stage seal and comprises ten radially outwardly extending fins 62.

The labyrinth seal assembly 60 is divided into two parts by a second chamber 66. The second chamber 66 is positioned between two axially adjacent fins 62 and the position of the second chamber 66 is such that the pressure of fluid in the second chamber 66 is sufficient to provide fluid cooling of one of the stages of hollow fluid cooled turbine rotor blades 28,30 or 32. In this example the pressure in the second chamber 66 is chosen to be sufficient to provide cooling for the second stage of turbine rotor blades 30. The second chamber 66 is positioned between the third and fourth fins 62 in the direction of the leakage flow B of fluid from the second chamber 66. The first part 68 of the labyrinth seal assembly 60 comprises the first three fins 62 and the second part 70 of the labyrinth seal assembly 60 comprises the remaining seven fins 62.

It is to be noted that the outer diameter of the turbine rotor 26 and the inner diameter of the inner platforms, of the stator vanes 46, of the inner casing 44 in the region upstream of the predetermined position, with respect to the direction of the leakage flow B of fluid through the multi-stage seal 60, i.e in the first part 68 of the labyrinth seal 60, are equal to the outer diameter of the turbine rotor 26 and the inner diameter of the inner platforms, of the stator vanes 46, of the inner casing 44 respectively in the region downstream of the predetermined position, i.e. in the second part 70 of the labyrinth seal 60.

The turbine rotor 26 is provided with passages 72 which extends in an axially upstream direction from the second chamber 66 to a third chamber 74, defined between the turbine rotor 26 and the shrouds on the radially inner ends of the turbine stator vanes 42. The turbine rotor 26 has passages 76 which interconnect the third chamber 74 and the cooling passage in the hollow fluid cooled turbine rotor blades 30. The passages 72, the third chamber 74 and the passages 76 allow a flow of cooling fluid C from the second chamber 66 to the turbine rotor blades 30. A plurality of passages 78 extend in an axially upstream direction through the turbine rotor 26 from the downstream surface 50 of the turbine rotor 26 to the second chamber 66.

The pressure of fluid in the second chamber 66 is less than that which would normally exist in the second chamber 66, because fluid is being supplied from the second chamber 66 to the second stage of turbine rotor blades 30. The flow of fluid from the second chamber 66, through the second part 70 of the labyrinth seal 60, to the flowpath through the turbine 22 is therefore reduced. In this example a 10% reduction of fluid leakage through the labyrinth seal is achieved. The leakage flow of fluid through the first part 68 of the labyrinth seal 60, from the first chamber 48 to the second chamber 66,is increased because the pressure in the second chamber 66 is reduced. However, this increased leakage flow of fluid through the first part 68 of the labyrinth seal 60 is insufficient to supply the leakage flow of fluid through the second part 70 of the labyrinth seal 60, albeit a reduced flow, and the flow of fluid to cool the second stage of turbine rotor blades 30. The deficit in the flow of fluid is made up by a restricted flow of fluid through the passages 78 from the first chamber 48 to the second chamber 66.

The fifth stage of compressor fluid has a sufficiently high pressure to achieve the required thrust load on the downstream surface 50 of the turbine rotor 26, and this is used to cool the second stage of turbine rotor blades 30. The use of fifth stage compressor fluid instead of using compressor delivery fluid gives performance benefits by using cooler and cheaper fluid.

Figure 4:
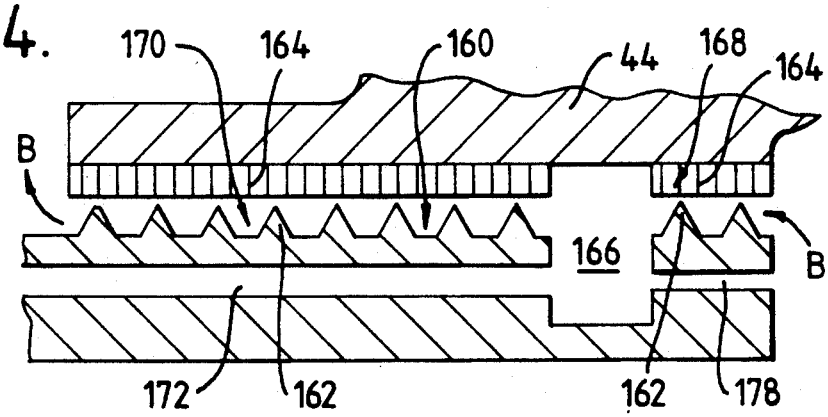
FIG. 4 is a further enlarged cross-sectional view through an alternative multi-stage seal shown in FIG. 2.

An alternative second seal assembly 160, shown more clearly in FIG. 4, is a labyrinth type seal which comprises a plurality of axially spaced, radially outwardly extending, fins 162 on the turbine rotor 26 and a honeycomb structure 164 on the inner platforms, of the stator vanes 46, of the inner casing 44. The labyrinth seal assembly 160 is a multi-stage seal and comprises ten radially outwardly extending fins 162.

The labyrinth seal assembly 160 is divided into two parts by a second chamber 166. The second chamber 166 is positioned between two axially adjacent fins 162 and the position of the second chamber 166 is such that the pressure of fluid in the second chamber 166 is sufficient to provide fluid cooling of one of the stages of hollow fluid cooled turbine rotor blades 28,30 or 32. In this example the pressure in the second chamber 166 is chosen to be sufficient to provide cooling for the second stage of turbine rotor blades 30. The second chamber 166 is positioned between the second and third fins 162 in the direction of the leakage flow B of fluid from the second chamber 166. The first part 168 of the labyrinth seal assembly 160 comprises the first two fins 162 and the second part 170 of the labyrinth seal assembly 160 comprises the remaining eight fins 162.

It is to be noted that the outer diameter of the turbine rotor 26 and the inner diameter of the inner platforms, of the stator vanes 46, of the inner casing 44 in the region upstream of the predetermined position, with respect to the direction of the leakage flow B of fluid through the multi-stage seal 160, i.e in the first part 168 of the labyrinth seal 160, are equal to the outer diameter of the turbine rotor 26 and the inner diameter of the inner platforms, of the stator vanes 46, of the inner casing 44 respectively in the region downstream of the predetermined position, i.e. in the second part 170 of the labyrinth seal 160.

In this example a 15% reduction of fluid leakage through the labyrinth seal is achieved.

Figure 5:
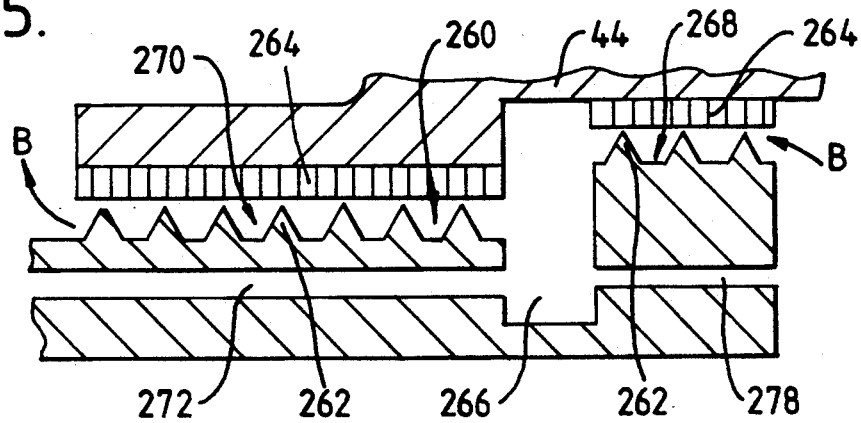
FIG. 5 is a further enlarged cross-sectional view through a further alternative multi-stage seal shown in FIG. 2.

An alternative second seal assembly 260, shown more clearly in FIG. 5, is a labyrinth type seal which comprises a plurality of axially spaced, radially outwardly extending, fins 262 on the turbine rotor 26 and a honeycomb structure 264 on the inner platforms, of the stator vanes 46, of the inner casing 44. The labyrinth seal assembly 260 is a multi-stage seal and comprises ten radially outwardly extending fins 262.

The labyrinth seal assembly 260 is divided into two parts by a second chamber 266. The second chamber 266 is positioned between two axially adjacent fins 262 and the position of the second chamber 266 is such that the pressure of fluid in the second chamber 266 is sufficient to provide fluid cooling of one of the stages of hollow fluid cooled turbine rotor blades 28,30 or 32. In this example the pressure in the second chamber 266 is chosen to be sufficient to provide cooling for the second stage of turbine rotor blades 30. The second chamber 266 is positioned between the third and fourth fins 262 in the direction of the leakage flow B of fluid from the second chamber 266. The first part 268 of the labyrinth seal assembly 260 comprises the first three fins 262 and the second part 270 of the labyrinth seal assembly 260 comprises the remaining seven fins 262.

It is to be noted that the outer diameter of the turbine rotor 26 and the inner diameter of the inner platforms, of the stator vanes 46, of the inner casing 44 in the region upstream of the predetermined position, with respect to the direction of the leakage flow B of fluid through the multi-stage seal 260, i.e in the first part 268 of the labyrinth seal 260, are greater than the outer diameter of the turbine rotor 26 and the inner diameter of the inner platforms, of the stator vanes 46, of the inner casing 44 respectively in the region downstream of the predetermined position, i.e. in the second part 270 of the labyrinth seal 260.

This arrangement allows the thrust load on the downstream surface 50 of the turbine rotor 26 to be increased for the same pressure of fluid in the first chamber 48, or allows the thrust load on the downstream surface 50 of the turbine rotor 26 to be maintained while the pressure of fluid in the first chamber 48 is reduced.

Although the present invention has been described by way of example with reference to a labyrinth seal, it may be possible to apply the invention to other suitable multi-stage seals. The present invention has also referred to a ten stage seal, it is also within the scope of the invention to use multi-stage seals with other than ten stages. Although the invention has referred to supplying the fluid bled from the multi-stage seal to a stage of turbine rotor blades it may be equally possible to supply the fluid to other components in the turbine for cooling thereof.

It may also be possible, in some turbine designs, for the downstream stages of turbine rotor blades e.g. the third stage rotor blades 32, and for the downstream stages of the turbine stator vanes e.g. the third stage stator vanes 42, to be solid and therefore uncooled.

I claim:

1. An axial flow turbine assembly comprising means defining a radially inner extremity of an annular turbine flowpath, means defining a radially outer extremity of the annular turbine flowpath, a turbine rotor being rotatably mounted about an axis, the turbine rotor having an axially downstream surface, the turbine rotor having at least one stage of radially outwardly extending turbine rotor blades in said flowpath, a turbine stator having an outer casing defining at least a portion of the radially outer extremity of said flowpath, the outer casing including at least one stage of radially inwardly extending turbine stator vanes in said flowpath, the turbine stator vanes having inner platform means defining at least a portion of the radially inner extremity of said flowpath, the axially downstream surface of the turbine rotor and the inner platform means at least partially defining a first chamber, means being arranged to supply fluid at a predetermined pressure into the first chamber to provide a thrust load acting in an axially upstream direction on the axially downstream surface of the turbine rotor to oppose loads acting on the turbine rotor, a multi-stage seal being arranged between the turbine rotor and the inner platform means to control a leakage flow of fluid from the first chamber into said flowpath, means to bleed fluid from a predetermined position in the multi-stage seal to reduce the leakage flow of fluid from the first chamber into said flowpath through the multi-stage seal, means to supply the fluid bled from the multi-stage seal to cool at least one component of the turbine assembly.

2. A turbine assembly as claimed in claim 1 in which the at least one component is a stage of fluid cooled hollow turbine blades.

3. A turbine assembly as claimed in claim 1 in which the multi-stage seal is a labyrinth seal, the labyrinth seal comprises a plurality of axially spaced fins.

4. A turbine assembly as claimed in claim 3 in which the fins extend radially outwardly from the turbine rotor.

5. A turbine assembly as claimed in claim 3 in which the predetermined position is between two axially adjacent fins.

6. A turbine assembly as claimed in claim 5 in which a second chamber is formed between the axially adjacent fins.

7. A turbine assembly as claimed in claim 3 in which the multi-stage seal is a ten stage seal.

8. A turbine assembly as claimed in claim 7 in which the predetermined position is between the third and fourth fin with respect to the direction of the leakage flow of fluid through the seal.

9. A turbine assembly as claimed in claim 7 in which the predetermined position is between the second and third fins with respect to the direction of the leakage flow of fluid through the seal.

10. A turbine assembly as claimed in claim 1 in which the turbine assembly is a low pressure turbine.

11. A turbine assembly as claimed in claim 6 in which the turbine rotor comprises at least one passage to interconnect the second chamber and the stage of turbine blades supplied with fluid.

12. A turbine assembly as claimed in claim 1 in which the outer diameter of the turbine rotor and the inner diameter of the inner platform means in the region upstream of the predetermined position, with respect to the direction of the leakage flow of fluid through the multi-stage seal, are greater than the outer diameter of the turbine rotor and the inner diameter of the inner platform means in the region downstream of the predetermined position.

13. A turbine assembly as claimed in claim 1 in which the turbine rotor comprises a plurality of stages of turbine rotor blades and the outer casing comprises a plurality of stages of turbine stator vanes.

14. A turbine assembly as claimed in claim 13 in which the turbine rotor comprises three stages of turbine rotor blades and the outer casing comprises three stages of turbine stator vanes.

15. A turbine assembly as claimed in claim 14 in which the fluid bled from the multi-stage seal is supplied to the second stage of turbine rotor blades.

16. A turbine assembly as claimed in claim 1 in which the means to supply pressurising fluid to the first chamber is a compressor.

17. A turbine assembly as claimed in claim 6 in which the turbine rotor has at least one restricted passage to interconnect the first chamber and the second chamber.

18. A turbine assembly as claimed in claim 16 in which the turbine assembly and the compressor are portions of a gas turbine engine.

* * * * *